US009308655B2

(12) United States Patent
Peppett

(10) Patent No.: US 9,308,655 B2
(45) Date of Patent: Apr. 12, 2016

(54) TWO WHEELED, HAND DRIVEN, LAMINA MATERIAL, SHAPE CUTTER

(71) Applicant: Robert Anthony Peppett, Svitavy (CZ)

(72) Inventor: Robert Anthony Peppett, Svitavy (CZ)

( * ) Notice: Subject to any disclaimer, the term of this patent is extended or adjusted under 35 U.S.C. 154(b) by 0 days.

(21) Appl. No.: 14/275,228

(22) Filed: May 12, 2014

(65) Prior Publication Data

US 2015/0321363 A1 Nov. 12, 2015

(51) Int. Cl.
*B26B 5/00* (2006.01)

(52) U.S. Cl.
CPC ..... *B26B 5/006* (2013.01)

(58) Field of Classification Search
CPC ..... A41H 31/005; B27G 17/04; B26B 3/00–3/08; B26B 5/00; B26B 5/005; B26B 27/00; B26B 29/02; B26B 29/06; B26B 5/006
USPC ..... 30/DIG. 3, 280, 282–286, 288–291, 30/293, 294, 312–314, 317, 320, 321; D8/98
See application file for complete search history.

(56) References Cited

U.S. PATENT DOCUMENTS

| | | | | | |
|---|---|---|---|---|---|
| 2,439,639 | A | * | 4/1948 | Tilly | 30/DIG. 3 |
| 2,535,555 | A | * | 12/1950 | Tilly | 30/DIG. 3 |
| 3,137,192 | A | | 6/1964 | Mcneill | |
| 3,286,351 | A | * | 11/1966 | McAlister | 30/293 |
| 3,365,798 | A | * | 1/1968 | Cunningham | 30/294 |
| 3,380,159 | A | * | 4/1968 | Winston | 30/293 |
| 3,513,744 | A | | 5/1970 | Hershberger | |
| 3,613,241 | A | * | 10/1971 | Allen | 30/294 |
| 3,859,725 | A | | 1/1975 | Anderson et al. | |
| 3,921,287 | A | * | 11/1975 | Gomez | 30/280 |
| 3,934,342 | A | * | 1/1976 | Matsushita | 30/293 |
| 4,062,116 | A | | 12/1977 | Arnott | |
| 4,068,375 | A | * | 1/1978 | Rathbun et al. | 30/162 |
| 4,109,380 | A | * | 8/1978 | Anderson | 30/162 |
| 4,884,342 | A | * | 12/1989 | McNamara et al. | 30/162 |
| 5,174,028 | A | * | 12/1992 | Seltzer, Jr. | 30/329 |
| 5,347,719 | A | * | 9/1994 | Scharf | 30/294 |
| 5,419,044 | A | * | 5/1995 | Valliere | 30/DIG. 3 |
| 5,438,757 | A | | 8/1995 | Weschenfelder | |

(Continued)

FOREIGN PATENT DOCUMENTS

| | | | |
|---|---|---|---|
| CH | 455680 | A | 5/1968 |
| DE | 20212218 | U1 | 1/2003 |

(Continued)

OTHER PUBLICATIONS

Deutshes Patent—Und Markenamt, German Search Report, May 6, 2015.

*Primary Examiner* — Jason Daniel Prone

(57) ABSTRACT

A hand driven cutting device having a substantially pistol shaped body assembly, a knife blade clamped between a first substantially pistol shaped body part and a second substantially pistol shaped body part of the substantially pistol shaped body assembly, a pair of wheels with each wheel attached to the lower periphery of each front end portion via an axle and lifting and supporting element extending from the rear of the front end portion. The cutting action of a material work piece is facilitated by a stress induced on the material work piece at the point of contact between the material work piece and the cutting edge of the knife blade due to stretching of work piece against clamping pressure exerted by the pair of wheels on the material work piece when the cutting device is pushed forward by a user.

18 Claims, 6 Drawing Sheets

(56) References Cited

U.S. PATENT DOCUMENTS

| | | | | |
|---|---|---|---|---|
| 5,638,603 | A * | 6/1997 | Li | 30/280 |
| D418,036 | S * | 12/1999 | Shearer | D8/98 |
| 6,112,417 | A | 9/2000 | Hyer | |
| 6,226,824 | B1 | 5/2001 | Hopson | |
| 6,684,512 | B1 | 2/2004 | Bareis | |
| 6,748,659 | B1 * | 6/2004 | Street | 30/294 |
| 6,857,192 | B1 * | 2/2005 | Summers et al. | 30/294 |
| 6,952,878 | B1 | 10/2005 | Bareis | |
| 7,051,443 | B2 * | 5/2006 | Mueller | 30/286 |
| 7,526,865 | B2 * | 5/2009 | Mueller | 30/286 |
| D649,854 | S * | 12/2011 | Packard et al. | D8/98 |
| 8,220,162 | B2 | 7/2012 | Rayner | |
| 8,495,818 | B1 * | 7/2013 | Peppett | 30/280 |
| 2002/0062566 | A1 * | 5/2002 | Janser | 30/290 |
| 2008/0250654 | A1 | 10/2008 | Chang | |
| 2013/0160303 | A1 * | 6/2013 | Everett | 30/294 |
| 2013/0312271 | A1 * | 11/2013 | Floyd et al. | 30/294 |

FOREIGN PATENT DOCUMENTS

| | | | |
|---|---|---|---|
| GB | 2277705 | A * | 11/1994 |
| WO | 9605027 | A1 | 2/1996 |

* cited by examiner

TWO WHEELED, HAND DRIVEN, LAMINA MATERIAL, SHAPE CUTTER

FIELD OF THE INVENTION

The present invention relates to a lamina cutting device. More particularly, the present invention relates to a portable, manual shape cutting device for cutting a wide variety of lamina material into shapes.

BACKGROUND OF THE INVENTION

Numerous manual, hand driven tools for cutting similar material have been provided in prior art. For example U.S. Pat. No. 3,137,192, U.S. Pat. No. 3,513,744, U.S. Pat. No. 3,859,725, U.S. Pat. No. 4,062,116, U.S. Pat. No. 5,438,757, U.S. Pat. No. 6,112,417, U.S. Pat. No. 6,226,824, U.S. Pat. No. 6,684,512, U.S. Pat. No. 6,952,878, U.S. Pat. No. 8,220,162, US Pat No 20080250654, GB Pat No 2277705A. While these units may be suitable for the particular purpose to which they address, they would not be suitable for the purposes of the present invention as heretofore described.

U.S. Pat. No. 3,137,192 issued to Mcneill Robert M on Jun. 16, 1964 titled Material cutting device discloses a device designed to cut paper and the like and, more particularly, to a cutting head and rail which accurately and reproducibly cut materials of a wide variety of thickness and finish. In case of this device, the material being cut is held firmly in position to produce accurate and reproducible cuts without the necessity for manually holding or adjusting the material to compensate for the shifting of position of the material caused by the build-up of unbalancing forces during the cutting operation.

U.S. Pat. No. 3,513,744 issued to Hershberger Paul R on May 26, 1970 titled Map or chart cutter discloses a device for cutting out a portion of a large map or navigation chart, the portion so cut out being of interest to personnel of a vehicle travelling between two locations represented by points on the map. A carriage mounted on rollers supports a pair of spaced-apart cutting edges which, as the carriage is manually moved along a guide overlying the two points of interest on the map, cuts out from the latter a strip which can be conveniently handled by personnel of the vehicle without being encumbered with the remaining map portion which contains nothing of interest insofar as this particular journey of the vehicle is concerned.

U.S. Pat. No. 3,859,725 issued to Alexander Gilbert L on Jan. 14, 1975 titled Carpet cutting tool discloses a manually operated carpet cutting tool wherein a pair of spaced carpet receiving jaw members have transversely extending there between a cutting blade having its cutting edge sloping rearwardly and being held at its rearward edge in a slot provided in a pile comb. A cut pressure and cutting start member parallels each side of the jaws and is mounted at one end thereof for pivotal motion to initiate cutting.

U.S. Pat. No. 4,062,116 issued to Arnott Gertrude V on Dec. 13, 1977 titled Fabric cutting tool discloses a fabric cutting tool comprising an elongated shank curved and bifurcated at one end and a handle on the other, the bifurcated end having a spring loaded rotary cutting blade rollingly mounted between the bifurcation, a protective shield for the blade, a pair of guide wheels for assisting in the cutting, and a foot plate providing a cutting surface for the fabric U.S. Pat. No. 5,438,757 issued to Weschenfelder; Sonja on Aug. 8, 1995 titled Multifunction cutting tool discloses a multifunction cutting tool which includes a cutting head adjustable for straight, free form or circular cutting of glass and tile, interchangeably mountable hobby and hook blades for cutting carpet, PVC, matting and the like, a roller cutter for cutting cloth, wallpaper, leather and similar sheet material, knife and scissor sharpeners and an angled carpet cutter blade mounted in a carriage with a base plate for sliding under the carpet. The tool has blade guards to protect the user from accidental injury and brackets supporting the cutting blades that are stabilized by resilient snap fittings and laterally extending support shoulders. Access to retractable folding hobby and hook blades is improved by the addition of screwdriver tip receiving pivot slots in the blades and the work surface of circular cuts is protected by a suction cup having a recessed and covered metal attachment.

U.S. Pat. No. 6,112,417 issued to Hyer; Michael L. on Sep. 5, 2000 titled Precision vinyl & carpet trimmer discloses a hand operated trimmer for trimming an edge of vinyl, carpet or the like being installed on a floor so that the cut edge of the floor covering will lie closely against an adjacent wall. The trimmer comprises an elongate base member and an integral cutting blade. The base member has a generally triangularly shaped cross section, with two of the elongate external surfaces of the base member meeting at a right angle, and the elongate external surface opposite the right angle being a concave surface. The cutting blade is mounted closely adjacent the concave surface and in a substantially perpendicular relationship thereto. Pressure applying rollers are spaced a slight distance from the concave surface so as to define a vinyl-receiving entry location for a vinyl sheet to pass in a longitudinal direction along the concave surface, with the pressure applying rollers serving to keep the vinyl sheet in close contact with the concave surface. The cutting blade is mounted in alignment with the path of travel of the vinyl along the concave surface, whereby upon an installer causing a vinyl sheet to enter the entry location, the external surfaces of the base member meeting at a right angle can be moved longitudinally along the floor-wall intersection. At that time the blade cuts the vinyl at a location coinciding with the intersection of the floor with the adjacent wall, such that the cut edge of the vinyl will reside closely and evenly along the wall.

U.S. Pat. No. 6,226,824 issued to Eric J. Hopson on May 8, 2001 titled Knife with multiple roller wheels discloses a knife with multiple roller wheels comprising an elongate hollow housing adapted to be held and operated by one hand. The housing has a first end with a slot and an opposite second end. A knife blade is provided. A structure is for retractably extending the knife blade from the slot in the first end of the housing to trim a window screen. Two roller wheels are also provided. A facility is for rotatably supporting in spaced apart relationships the two roller wheels. An assembly pivotally connects the supporting facility to one side of the housing adjacent to the second end. A stop member supports the supporting facility in a stationary position, so that one of the roller wheels will extend beyond the second end of the housing to install the window screen in a window screen frame.

U.S. Pat. No. 6,684,512 issued to Kathryn M. Bareis on Feb. 3, 2004 titled Rolling sheet material cutting device discloses a rolling device for cutting sheet material including a planar body member supported vertically on wheeled axles oriented perpendicularly to the vertical planar body member. The planar body member includes a cutting notch and a contained cutting blade member with a cutting edge exposed within the cutting notch. A handle member is secured to the planar body member and extends upwardly opposite the wheeled axles. A crossbar can be attached to the handle member. A user grasps the handle member, or crossbar, and rolls the planar body member forward on the wheeled axles to cut a sheet of material passing into the cutting notch U.S. Pat. No. 6,952,878 issued to Bareis Kathryn on Oct. 11, 2005 titled Mobile sheet material cutting device discloses a self-standing mobile device for cutting sheet material including a body member connected to at least one wheeled axle to translationally move the body member about a surface on which the device self-stands. The body member includes a cutting notch with open and closed ends, the cutting notch positioned with the open end above the at least one wheeled axle. The body member including a contained cutting blade member with cutting edge exposed within the cutting notch closed end, the cutting blade member oriented substantially perpendicularly to the surface on which the device self-stands. A user may engage the device to move the device about the surface on the at least one wheeled axle to cut a sheet of material passing into the cutting notch. Handle and shoulder features, and related methods of cutting sheet material are also disclosed.

U.S. Pat. No. 8,220,162 issued to Rayner Design Pty Ltd on Jul. 17, 2012 titled Cutter device discloses a manually operable cutter device for cutting flexible sheet material, the cutter device comprising a cutter body and a cutting blade assembly operatively mounted to the cutter body and including a rotatable cutter blade having a peripheral edge portion and a fixed cutter blade adapted to cooperate together to provide a cutting zone in which sheet material can be cut. The rotatable cutting blade is mounted for rotation about an axis which extends generally laterally with respect to a normal feed direction of the sheet material to the cutting zone and the direction of rotation of the peripheral edge portion through the cutting zone is in the normal feed direction.

US20080250654 issued to Pi-Chao Chang on Oct. 16, 2008 titled Dual-use knife discloses a device having a circular blade and a guide rod combined together. A dual-use knife having a circular blade and a guide rod combined together. When the rotatable circular blade is attached to a cloth-cutting guide rode a positioning cutting state of the stationary circular blade can be obtained so that the application range of the circular blade can be enlarged. In addition, the circular blade or the combination of the cloth-cutting guide rod and the circular blade can be positioned and operated on two sides of the knife so that the knife may be properly held by left and right hands. In addition, when the circular blade is combined with the guide rod, a circular blade upper cover can be rotated so that the position of the cutting point of the circular blade may be arbitrarily changed from 0 to 360 degrees, and a multi-function knife may be formed.

GB2277705A titled Kitchen packaging cutter discloses a kitchen packaging cutter has a replaceable blade 2 clamped by a plate 3 to a body 1. A guide slot 6 is formed through the body length. A free turning roller 4 protrudes slightly over the guide slot 6 with a cutting edge of the blade 2 just clearing roller 4. The guide slot allows plastic food packs and cartons with varying flange measurements to pass between the cutting blade and roller to facilitate the cutting of the package and subsequent release of its contents. A second protruding cutting edge of blade 2 is sighted to the left of the body in right angle 7 and enables the opening of cardboard boxes, whether wrapped in plastic or cellophane, with little effort. A push-pull blade guard 9 may be fitted to the body to guard the second cutting edge

OBJECTS OF THE INVENTION

The cutting device according to the present invention is especially designed to cut lamina materials into shapes, at the same time due to its design it is safe, efficient, conveniently mobile and very easy to use.

One object of the present invention is to provide a hand held manually driven cutting device especially designed for shape cutting of lamina materials that in most situations is able to cut as quickly and accurately as scissors, craft knives, battery and manual powered rotating knife's. At the same time, due to its design, the cutting device of the present invention is cheaply available to the end user. Furthermore, unlike alternative cutting knives, it performs a cutting operation whilst eliminating the risk of injury to the operator.

Another object is to provide a hand held manually driven cutting device that is able to cut at an acute radius or angle a lamina material without compromising operating time constraints and accuracy.

Still another object is to provide an ambidextrous shape cutting device that can be operated using a single hand with equal facility by both left and right handed operator.

A further object is to provide a shape cutting device for which it is possible to use commonly available cutting blades such as the blades found in low cost craft knives.

A still further object is to provide a shape cutting device having an ergonomic design.

A still further object is to provide a shape cutting device having a graspable body that is dividable into two parts along its vertical axis.

Yet another object is to provide a shape cutting device with a material lifting and supporting element that is extending from the underside of the graspable body wherein the lifting and supporting element is clamped into position when both parts of the graspable body are joined together by means of screws.

A still further object is to provide a shape cutting device that, during operation and storage, prevents any possibility of accidental human contact with the knife blade. A still further object is to provide a shape cutting device that during operation, the lifting and supporting element combined with the outer walls of the front end portion of the substantially pistol shaped graspable body assembly are arranged to prevent any possibility of accidental human contact with the knife blade.

Yet another object is to provide a shape cutting device that prevents the point of the knife blade from causing any undercut scoring or damage upon the working surface.

A still further object is to provide a shape cutting device wherein the possibility of nicking or movement of the material during the cutting process is considerably diminished.

A still further object is to provide a shape cutting device that utilizes a cutting blade positioned at the center in between a pair of wheels with the cutting edge of the blade lying in line with the axle of the pair of wheels.

SUMMARY OF THE INVENTION

The following presents a simplified summary in order to provide a basic understanding of some aspects of the disclosed invention. This summary is not an extensive overview, and it is not intended to identify key/critical elements or to delineate the scope thereof. Its sole purpose is to present some concepts in a simplified form as a prelude to the more detailed description that is presented later.

Accordingly, there is provided a hand driven shape cutting device wherein the graspable body is of substantially pistol shape having a front end portion and protruding rearward graspable handle so that when the device is clasped by the hand of the user to impart a forwardly actuating force, the front end portion defines an inclined force entry direction whereby, in association with the actuating rolling motion, clamping down force is applied through the wheels onto the material to be cut.

The hand held cutting device comprises a two part dividable rigid substantially pistol shaped body assembly, each substantially pistol shaped body part having a mirror image outer surface and periphery that, when coupled with its partner, results in an assembly forming an ambidextrous graspable handle; a knife blade clamped firmly between the two substantially pistol shaped body parts with its cutting edge protruding forwardly beneath the front end portion of the substantially pistol shaped body assembly; a pair of wheels, each wheel attached to an axle, situated to lower rear distal point on either outer side of the front end portion of the substantially pistol shaped body assembly; a lifting and supporting element extending from the underside of the front end portion wherein an engagement space for material to be lifted is apportioned between the distal front edge of the lifting and supporting element and the forward distal point of the front end portion facing the direction of travel, the lifting and supporting element is arranged to lift the material to be cut and also form a protecting periphery such that any part of cutting edge of the knife does not protrude outside the periphery; the knife blade and supporting element are supported and clamped in position by the two substantially pistol shaped body parts which are detachably joined together by one or more fasteners. To improve cutting ability of the hand driven cutting device of the present invention, the flow passages on the upper surface of the lifting and supporting element are inclined, the leading edge of the flow passage being flush at the distal front upper surface of said lifting and supporting element, the flow passage extending rearward with an upward inclination to peak upon adjacent sides of the knife blade such that when the hand driven cutting device is driven forward, wherein material to be cut is introduced upon the leading edge of the lifting and supporting element, the flow passage guide the material to be cut into an actuated pincer and shearing action between the crest of the flow passage, the peripheral underside of the substantially pistol shaped body assembly and the cutting edge of the knife blade. The substantially pistol shaped body is provided with smoothly curved peripheral surface that provides graspable comfort for the operator, a graspable handle being the rearmost outer body periphery, extending outward and downwardly inclined from the irregular latitudinal apex of the substantially pistol shaped body assembly and rear-wardly away from the body distal point, the distal point being the front of the cutting device and direction of travel.

The two part body has symmetrical features to enable practical use by both left and right handed operator; the two part body is detachable/attachable to allow for interchanging the knife blade. The wheels are positioned to the outer lower periphery of the blade housing on opposing sides and in line with the cutting edge of the knife blade, whereby during the cutting process, in addition to enabling the cutter to travel, the wheels substantially clamp in position the material to be cut during the moment the material meets with the knife blade.

The wheels have a soft synthetic material on their outer perimeter to allow frictional gripping to take place upon the upper surface of the material to be cut. The knife blade to be clamped in the body is a replaceable type such as those commonly found in low cost craft knives.

To the accomplishment of the foregoing and related ends, certain illustrative aspects of the disclosed invention are described herein in connection with the following description and the annexed drawings. These aspects are indicative, however, of but a few of the various ways in which the principles disclosed herein can be employed and is intended to include all such aspects and their equivalents. Other advantages and novel features will become apparent from the following detailed description when considered in conjunction with the drawings.

BRIEF DESCRIPTION OF THE FIGURES

The foregoing features, objects and advantages of the invention will become apparent to those skilled in the art from the following detailed description of a preferred embodiment, especially when considered in conjunction with accompanying drawings in which like numerals in the several views refer to corresponding parts.

DETAILED DESCRIPTION OF THE PREFERRED EMBODIMENT

Figure 1:
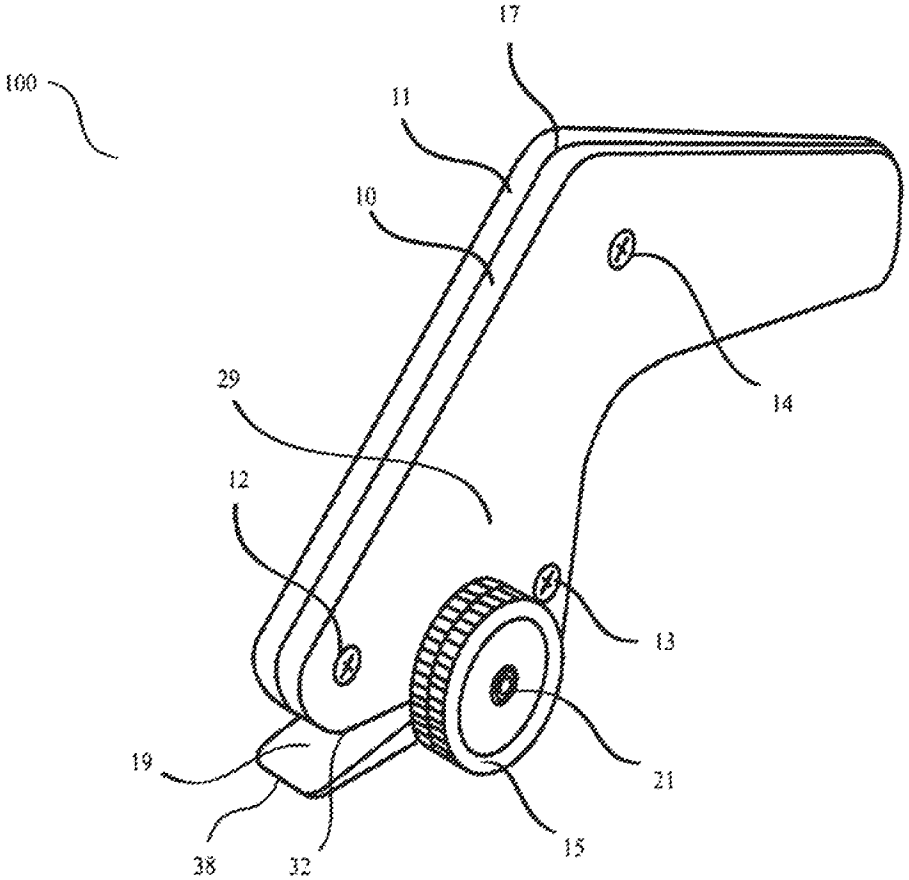
FIG. 1 is a perspective view of a hand driven cutting device in accordance with a preferred embodiment of the present invention.
Figure 2:
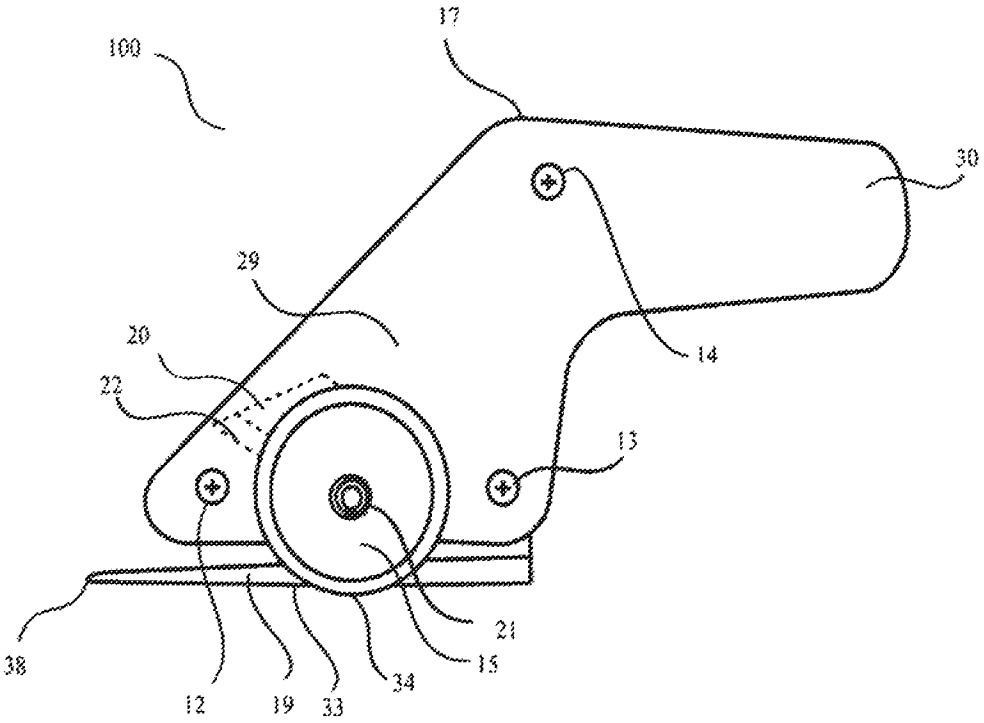
FIG. 2 is a right-side elevation view of a hand driven cutting device in accordance with a preferred embodiment of the present invention.
Figure 3:
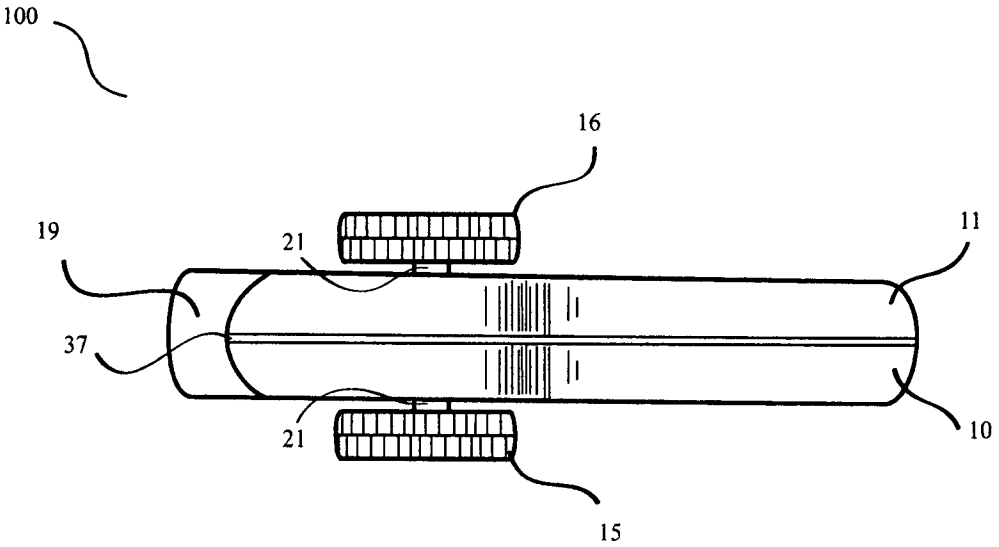
FIG. 3 is a top-plan view of a hand driven cutting device in accordance with a preferred embodiment of the present invention.

Turning now descriptive to the drawings, in which similar reference characters denote similar elements throughout the several views, FIG. 1 and FIG. 2 show a hand driven cutting device (100) of the present invention according to one preferred embodiment. The hand driven cutting device (100) has a substantially pistol shaped body assembly (17). The body assembly of the hand driven cutting device has a substantially triangular shaped portion and a substantially rectangular shaped portion protruding from the substantially triangular shaped portion. In a preferred embodiment, the substantially pistol shaped body assembly (17) is a two part, dividable, rigid structure comprising of a first substantially pistol shaped body part (10) and a second substantially pistol shaped body part (11). The first substantially pistol shaped body part (10) and the second substantially pistol shaped body part (11) are symmetrical relative to a plane between them and are mirror images of each other so that, when coupled with each other, the resultant assembly forms the substantially pistol shaped body assembly (17) having a front end portion (29) and protruding rearward projection (30). The protruding rearward projection (30) forms an ambidextrous graspable handle. The first and second substantially pistol shaped body parts (10,11) can be made up of any material such as durable plastic, aluminum or steel.

Figure 6:
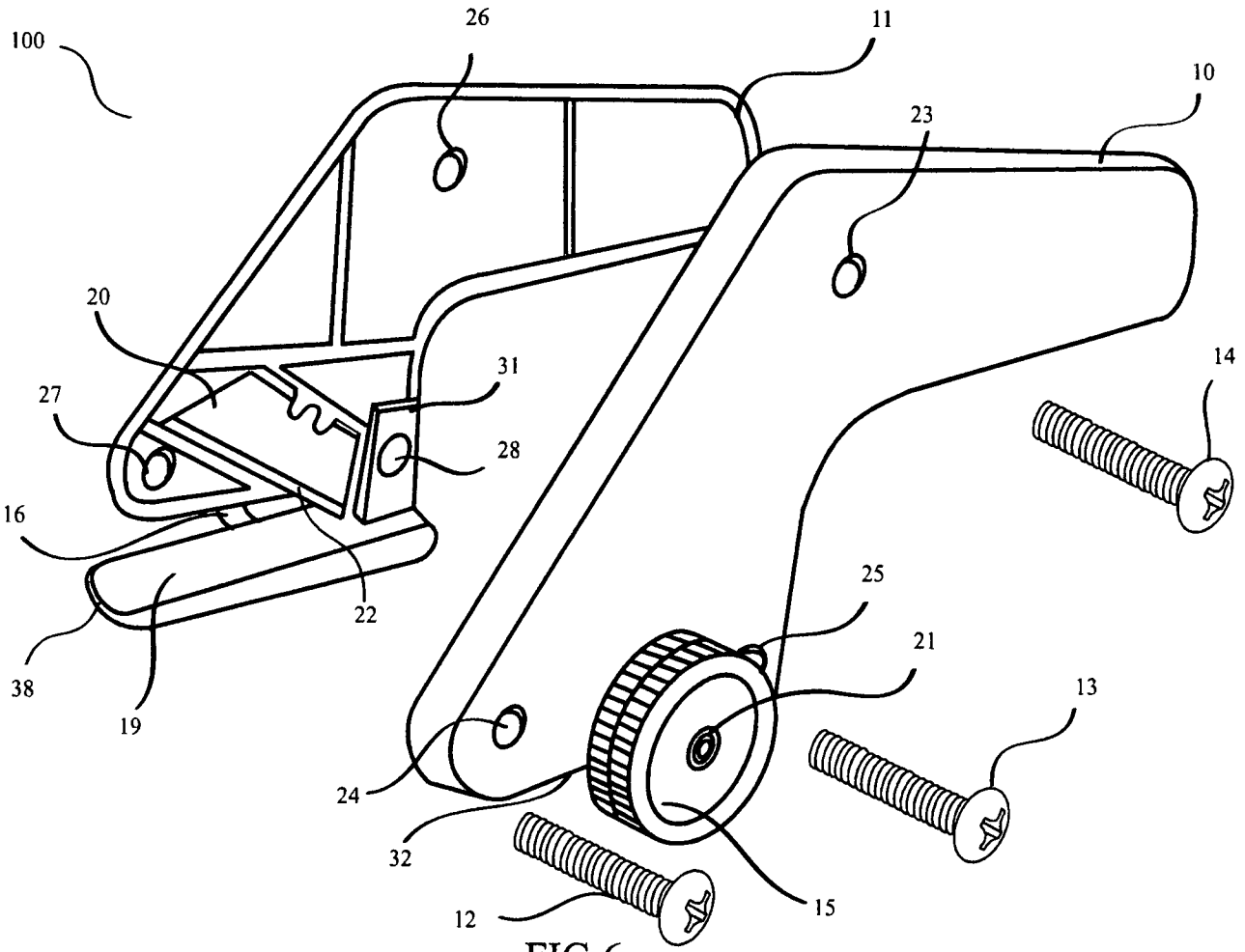
FIG. 6 is a pre-assembly view of a hand driven cutting device in accordance with a preferred embodiment of the present invention.

In a preferred embodiment, the first and second substantially pistol shaped body parts (10,11) are detachably attached together by suitable one or more fasteners such as screws (12), (13) and (14) as shown in FIG. 1, FIG. 2 and FIG. 6.

FIG. 2 and FIG. 6 show a knife blade (20) with its cutting edge (22) facing the direction of travel of the hand driven cutting device (100). In a preferred embodiment, the knife blade (20) is clamped between the front end portion (29) of the first and second substantially pistol shaped body parts (10, 11) wherein the cutting edge (22) of the knife blade (20) protrudes from the underside (32) of the front end portion (29) of the first and second substantially pistol shaped body parts (10, 11) when they become assembled via fasteners. The knife blade (20) is positioned so that the cutting edge (22) faces the front distal point of the front end portion (29) of the substantially pistol shaped body assembly (17) in the direction of travel of the hand driven cutting device (100).

Reference to FIGS. 1 through 6, a pair of wheels (15) and (16) is attached to the either side of the front end portion (29) of the first and second substantially pistol shaped body parts (10, 11) via an axle (21). The axle (21) is preferably positioned in such a way that the cutting edge (22) of the knife blade (20) is centered between and in line with the axle (21) of the wheels (15) and (16). The pair of wheels (15, 16) enable the hand driven cutting device (100) to become turned on a vertical axis thereby facilitating cutting of a lamina material within an acute radius.

Reference to FIG. 1 through FIG. 6, the hand driven cutting device (100) further comprises a lifting and supporting element (19) which is a plastic or metallic wedge positioned beneath the rear of the front end portion (29) of the substantially pistol shaped body assembly (17). In a preferred embodiment, the lifting and supporting element (19) includes a planar supporting surface defining a leading edge (38) facing away from the pair of wheels (15, 16) and protruding beyond the forward distal periphery (37) of the front end portion (29) of the substantially pistol shaped body assembly (17) and is configured to pick up a material work piece to be cut. The upper surface of the lifting and supporting element (19) is upwardly disposed towards the rear of the front end portion (29) of the substantially pistol shaped body assembly (17) so that, when a work piece passes over the upper surface of the lifting and supporting element (19), the work piece gets stretched in relation with the downward clamping pressure exerted by the pair of wheels (15, 16). The lifting and supporting element (19) includes a central vertical supporting fin (31) that is clamped in place between the first and second substantially pistol shaped body parts (10, 11) when they are joined together by one or more fasteners (12, 13 and 14).

The lifting and supporting element (19) defines a flow passage for the material to be cut during the cutting action so that the cut materials, after being cut by the knife blade (20), pass through either side of the knife blade (20). In a preferred embodiment, the bottom (33) of the lifting and supporting element (19) remains substantially flush with bottom (34) of the pair of wheels (15) and (16) as shown in FIG. 2 and in FIG. 4. The lifting and supporting element (19) is configured to receive the knife blade (20) in such a way that the pointed protrusion of the cutting edge (22) of the knife blade (20) stops short of the upper surface of the lifting and supporting element (19) preventing the knife blade (20) from causing any undercut scoring or damage upon a work surface.

The outer side of the front end body portion (29) in combination with the lifting and supporting element (19) forms a protective periphery which precludes physical contact of a person with the knife blade (20) during the use of the hand driven cutting device (100) of the present invention.

Figure 4:
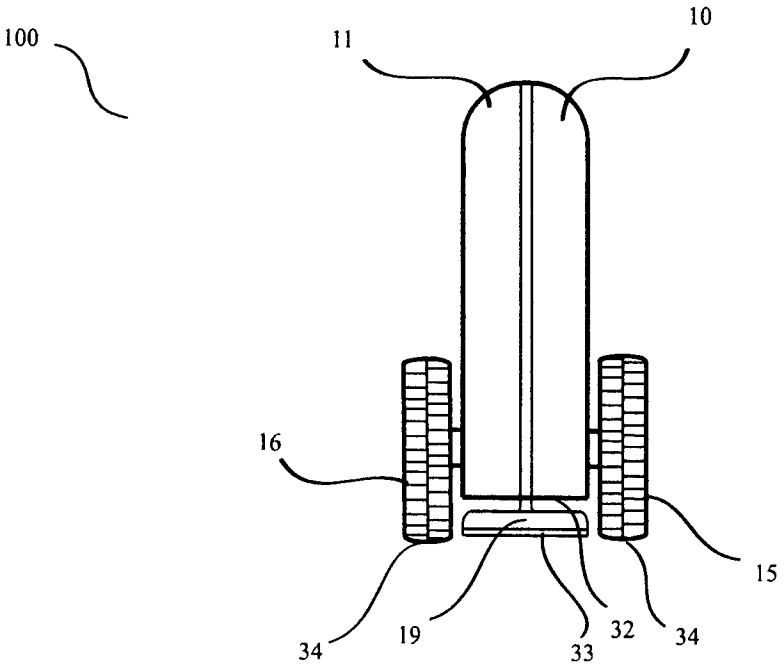
FIG. 4 is a front elevation view of a hand driven cutting device in accordance with a preferred embodiment of the present invention.
Figure 5:
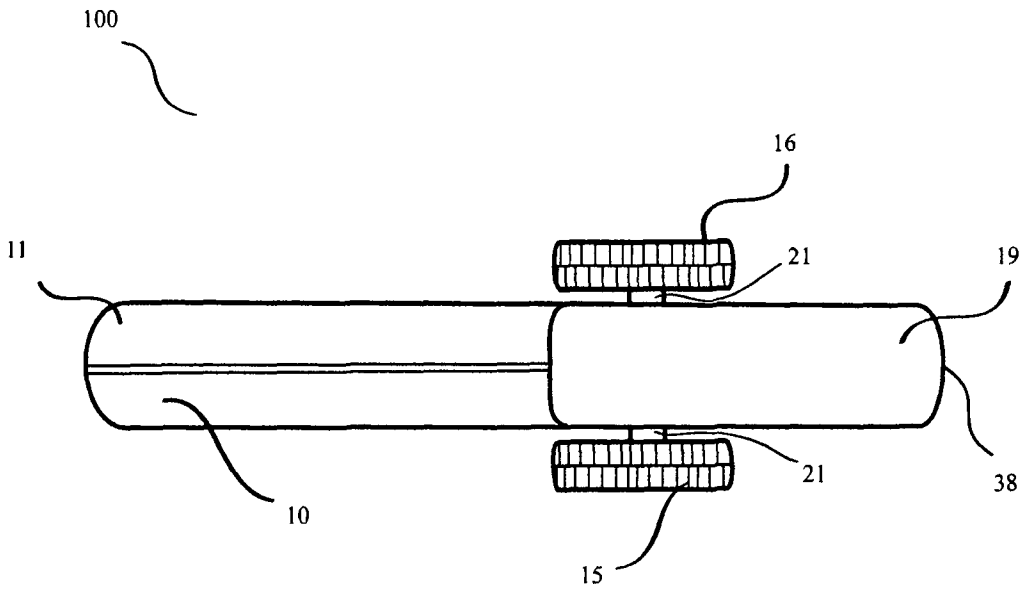
FIG. 5 is a bottom plan view of a hand driven cutting device in accordance with a preferred embodiment of the present invention.

FIG. 4 shows a front side view of the hand driven cutting device (100). The lifting and supporting element (19) is affixed in position in such a manner that there is a small gap between the underside (32) of the front end portion (29) of the substantially pistol shaped body parts (10,11) and the upper surface of the flow passage of the lifting and supporting element (19). This gap provides the flow passage for the material to be cut and when the hand driven cutting device (100) is driven forward, the flow passage guides the material to be cut into an actuated pincer and shearing action between the crest of the flow passage, the peripheral underside (32) of the body and the cutting edge (22) of the knife blade (20).

FIG. 6 shows the pre-assembly view of the hand driven cutting device (100). The substantially pistol shaped body parts (10) and (11) are shown separately. The knife blade (20) and the vertical fin (31) of the lifting and supporting element (19) becomes clamped firmly in position when the first and second substantially piston shaped body parts (10, 11) are joined together. FIG. 6 shows how the substantially pistol shaped body parts (10) and (11) are coupled together. The first substantially pistol shaped body part (10) has holes (23), (24) and (25) to receive jointing screws (12), (13) and (14). Similarly, the second substantially pistol shaped body part (11) has corresponding holes (26), (27) and (28). The holes are made at similar locations in both parts of the substantially pistol shaped body parts (10) and (11). The vertical fin (31) of the lifting and supporting element (19) also has a hole (28) through which jointing screw (13) is passed in order to hold it firmly in position. When the two substantially pistol shaped body parts (10) and (11) are coupled, the knife blade (20) and the vertical fin (31) of the lifting and supporting element (19) are clamped between the first and second substantially pistol shaped body parts (10) and (11). At the time of coupling, the screw (12) is tightened in the holes (24) and (27), screw (13) is tightened in the holes (25) and (28) and the screw (14) is tightened in the holes (23) and (26). When screws (12, 13) and (14) are tightened, the knife blade (20) is firmly clamped in a protruding position to the underside (32) of the substantially pistol shaped body parts (10) and (11).

Operation of the Device

The hand driven cutting device (100), when manually driven forward upon a work surface, utilizes its wheels (15) and (16) to provide motion and also apply stabilizing down force and clamping of the lamina material (i.e. the material work piece) whilst simultaneously cutting it. Also, mounted within the graspable substantially pistol shaped body assembly (17) is a material lifting and supporting element (19) situated beneath the underside (32) of the front end portion (29) below the knife blade (20) with its distal edge protruding forwardly enough to enable picking up of material which is to be cut and also to act as a safety shield for the knife blade (20). The lifting and supporting element (19) has, on its upper surface, a flow passage that is configured to pass opposing sides of the cutting knife blade (20). The flow passage is inclined upward from the leading edge (38) of the lifting and supporting element (19) with trailing edge of the flow passage becoming higher towards the rear of the underside (32) of the front end portion (29) so that, during the cutting process, material passing over it becomes guided into an actuating pincer and shearing action that takes place between the crest of the flow passage in the peripheral underside (32) of the body and the cutting edge (22) of the knife blade (20). Wheels (15, 16) with corresponding axles (21) are provided to the lower edge of the front end portion (29). Each wheel (15) and (16) is fitted on opposing sides with each wheel axis being aligned with the cutting edge of the knife blade (20).

When the cutting operation is started, the hand driven cutting device (100) is placed near the edge of lamina material to be cut and the hand driven cutting device (100) is then driven forward manually by grasping the graspable handle formed by the protruding rearward projection (30) of the substantially pistol shaped body assembly (17) by the hand of a user whereupon the edge of the material to be cut is picked up by the leading edge (38) of the lifting and supporting element (19). The ergonomic design of the protruding rearward projection (30) of the substantially pistol shaped body assembly (17) facilitates grasping the handle so formed and moving the cutting device (100) by either hand of a user. As the hand driven cutting device (100) is being driven further forward, the forward half of the lifting and supporting element (19) lies below the lamina material whilst the pair of wheels (15, 16) are still lying at the work surface and just about to mount the lamina material.

When force is applied in a further forward direction, the wheels (15, 16) come onto surface of the lamina material to be cut and, at the same time, the lamina material also comes in contact with cutting edge (22) of the knife blade (20). Upon exerting further forward force, the lamina material becomes cut by the knife blade (20). During the forward movement of the hand driven cutting device (100), the lamina material passes over the lifting and supporting element (19) while passing simultaneously beneath the wheels (15, 16). During such a movement, whereas the pair of wheels (15, 16) are applying downward pressure upon the lamina material, a stress becomes induced in the lamina material as the lamina material is being lifted and gradually passing over the upwardly disposed upper surface of the lifting and supporting element (19). Whilst the clamping pressure is exerted by the pair of wheels (15, 16), under this condition, as the lamina material reaches the cutting edge (22) of the knife blade (20), a smooth cutting operation is performed by the knife blade (20). At any time during the cutting process the lamina material lies above the lifting and supporting element (19) and below under the wheels (15, 16).

In a preferred embodiment of the present invention, the outer surface around each of the wheels (15) and (16) is trod with a synthetic soft compound that is imparting frictional gripping upon the upper surface of the material being cut.

The knife blade (20) is any suitable knife blade known in the art. To replace the knife blade (20) when it becomes blunt, the first and second substantially pistol shaped body parts (10) and (11) are detached by removing the fasteners (12), (13) and (14). Examples of the work piece material i.e. the lamina material cut into different regular and irregular shapes by the hand driven cutting device (100) of the present invention includes, but is not limited to, PVC and foils, vinyl membranes, technical textiles, papers, cards and the like.

It is noted that the embodiment of the hand driven cutting device with a pair of wheels described herein in detail for exemplary purpose is of course subject to many different variations in structure, design, application and methodology. Because many varying and different embodiments may be made within the scope of inventive concepts herein taught, and because many modifications may be made in the embodiment herein detailed in accordance with the descriptive requirements of the law, it is to be understood that the details herein are to be interpreted as illustrative and not in a limiting sense.

What is claimed is:

1. A cutting device comprising a body, said body comprising two opposing sides, said opposing sides being mirror images and each having a front end fastener hole, a rearward fastener hole, and a supporting fastener hole, said two opposing sides being connected together by a front end fastener disposed in said front end fastener holes, a rearward fastener disposed in said rearward fastener holes, and a supporting fastener disposed in said supporting fastener holes to form said body, said body having a forward facing substantially triangular portion and a rearward facing substantially rectangular portion, said front end fastener and said supporting fastener are located in said substantially triangular portion, said rearward fastener located in said substantially rectangular portion; a wedge member, said wedge member comprising a top side, a bottom side, a first end, a second end thicker than said first end, and a supporting element, said supporting element projecting upwards from said top side of said second end of said wedge member, said supporting element positioned in-between said opposing sides of said body in said substantially triangular portion, said supporting element has a central recess to receive said supporting fastener, said top side of said wedge extending along a bottom surface of said substantially triangular portion of said body to define a space therebetween; an interior cavity defined by said opposing sides of said body and extending through said bottom surface of said substantially triangular portion; a blade with a forward cutting edge and a rear dull edge, said blade being received in said cavity wherein a portion of said cutting edge extends outward from said bottom surface of said substantially triangular portion of said body and into said space so that said portion of said cutting edge is exposed; and two wheels rotatably mounted respectively on each side of said substantially triangular portion of said body.

2. Said cutting device of claim 1, wherein said bottom side of said wedge member is substantially flush with a bottom of each of said two wheels.

3. Said cutting device of claim 2, wherein each of said two wheels is encased in a gripping material, such that engaging said device by a user in a forward motion guides a material to be cut along said top side of said wedge member and beneath each of said two wheels, such that said material is tightly stretched for a smooth cut.

4. Said cutting device of claim 3 wherein said gripping material is an elastomeric rubber compound.

5. Said cutting device of claim 4, wherein said blade is trapezoidal in shape.

6. Said cutting device of claim 5, said cutting edge has a triangular point blade tip.

7. Said cutting device of claim 6, wherein said blade is angled upwards from said top side of said wedge member.

8. Said cutting device of claim 7, wherein said angle is greater than 15 degrees upwards from said top side of said wedge member.

9. Said cutting device of claim 8, wherein said front end fastener, said rearward fastener, and said supporting fastener are screws.

10. Said cutting device of claim 9, said rotatable mount between said wheels and said sides of said substantially triangular portion is an axle.

11. Said cutting device of claim 10, said cutting edge of said blade is above said top side of said wedge member.

12. A device for cutting lamina comprising: an elongate housing, said housing comprised of two opposing sides, each of said opposing sides being mirror images and having three apertures, said opposing sides connected together by disposing three fasteners respectively through each of said three apertures, said housing having a front substantially triangular portion and a rear substantially rectangular handle portion; a wedge member, said wedge member having a top side, a bottom side, a front first end, a rear second end thicker than said first end, and a vertical fin, said vertical fin located on said top side of said rear second end, said vertical fin having a central recess to receive one of said three fasteners to position said fin between said two opposing sides of said housing in said substantially triangular portion in such a way that a space is defined between said top side of said wedge member and a lower surface of said substantially triangular portion; an interior cavity defined by said opposing sides of said housing and extending through said bottom surface of said substantially triangular portion; a blade with a forward cutting edge and a rear dull edge, said blade being received in said cavity wherein a portion of said cutting edge extends outward from said bottom edge of said substantially triangular portion of said body and into said space so that said portion of said cutting edge is exposed; and two wheels rotatable supported respectively on opposing sides of said substantially triangular portion.

13. Said device in claim 12 wherein said bottom side of said wedge member is substantially flush with a bottom of each of said two wheels.

14. Said device in claim 13, wherein each of said two wheels are encased in a gripping material, such that engaging said device by a user in a forward motion guides a material to be cut along said top side of said wedge member and beneath each of said two wheels, such that said material is tightly stretched for a smooth cut.

15. Said device of claim 14 wherein said gripping material is comprised of an elastomeric rubber compound.

16. Said device of claim 15 wherein said blade is angled upwards at least 15 degrees from said top side of said wedge member.

17. Said device of claim 16, wherein said three fasteners are screws.

18. Said cutting device of claim 17, said rotatable support between said wheels and said sides of said substantially triangular portion are axles.

* * * * *